United States Patent [19]

Ingwersen

[11] 3,990,708

[45] Nov. 9, 1976

[54] INDOOR/OUTDOOR RECREATIONAL GOLF FACILITY

[76] Inventor: Samuel E. Ingwersen, 366 N. Stanberry, Columbus, Ohio 43209

[22] Filed: Jan. 27, 1975

[21] Appl. No.: 544,304

[52] U.S. Cl. ..... 273/176 A; 273/181 F; 273/181 A

[51] Int. Cl.[2] ..... A63B 69/36

[58] Field of Search ..... 273/176 A, 185 R, 185 B, 273/181, 182

[56] References Cited

UNITED STATES PATENTS

| | | | |
|---|---|---|---|
| 1,761,317 | 6/1930 | Strasser | 273/185 R X |
| 1,851,423 | 3/1932 | Ely | 273/176 A |
| 3,350,099 | 10/1967 | Smart | 273/176 A |
| 3,413,005 | 11/1968 | Stearns | 273/176 A |
| 3,464,703 | 9/1969 | Vallas | 273/176 A |
| 3,649,025 | 3/1972 | Garland | 273/176 A |
| 3,685,832 | 8/1972 | Johnson | 273/176 A |
| 3,877,704 | 4/1975 | Bayley | 273/176 A |

*Primary Examiner*—George J. Marlo

[57] ABSTRACT

An indoor/outdoor recreational golf facility having a plurality of indoor putting greens, an outdoor pitching green, a plurality of mechanized range greens simulating the conventional greens, and a plurality of driving tees. The mechanized range green has a ball retrieval system and electrically relays to a display register, situated adjacent the driving tee, the location of where the ball hit the green relative to a flagstick. The mechanized range green is comprised of a mesh-like netting material segmented into squares. Each square net is supported in a raised position by structural posts and guide wires, and each net slopes inward to a center position. The ball hitting a net rolls through a hole in the center and actuates the electrical position switch, and thereafter automatically returns to a retrieval area. The overall mechanized green is raised above the ground level with an artificial turf sloping to the ground simulating the approach apron. Each tee includes a display board that provides course information, i.e., distance of hole, par, and directs the player as to where and how to proceed with the game.

8 Claims, 8 Drawing Figures

FIG. 1
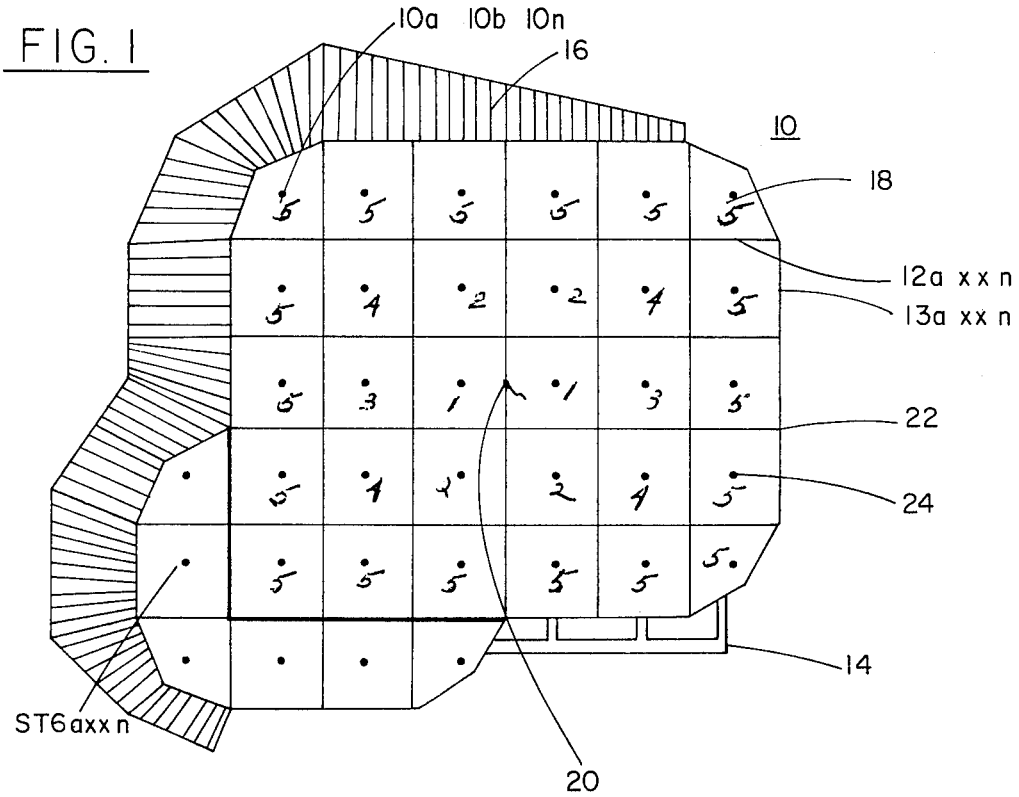
FIG. 2
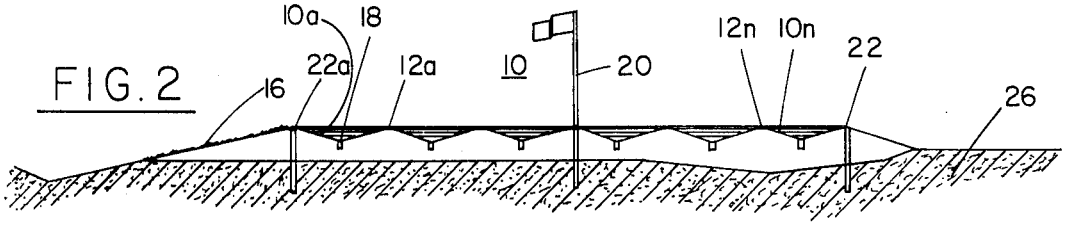
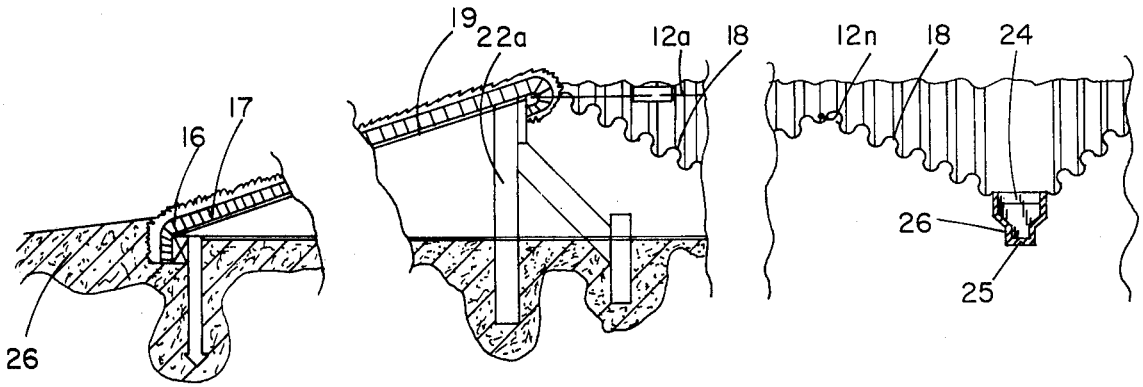
FIG. 3

FIG. 5
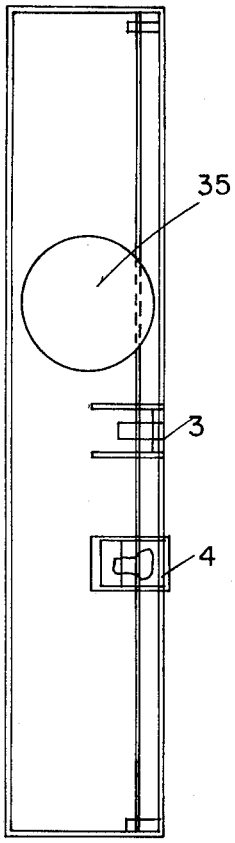
FIG. 4
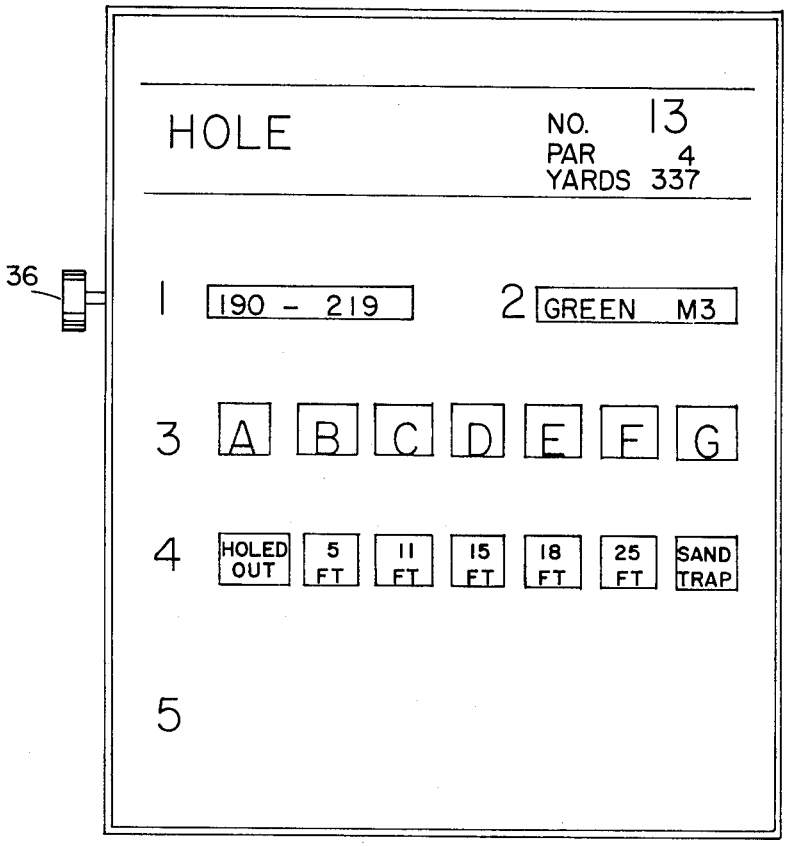
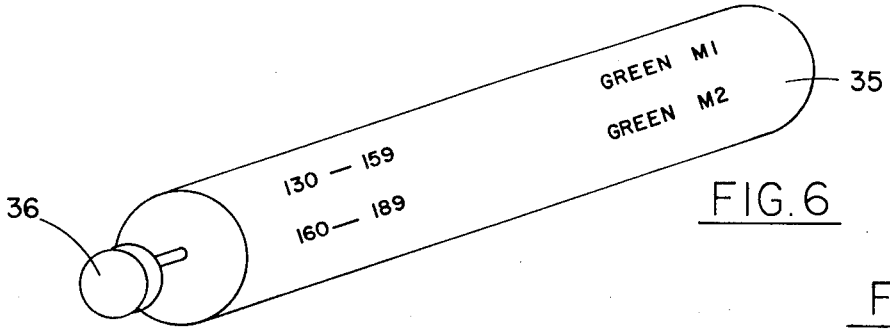
FIG. 6
FIG. 7
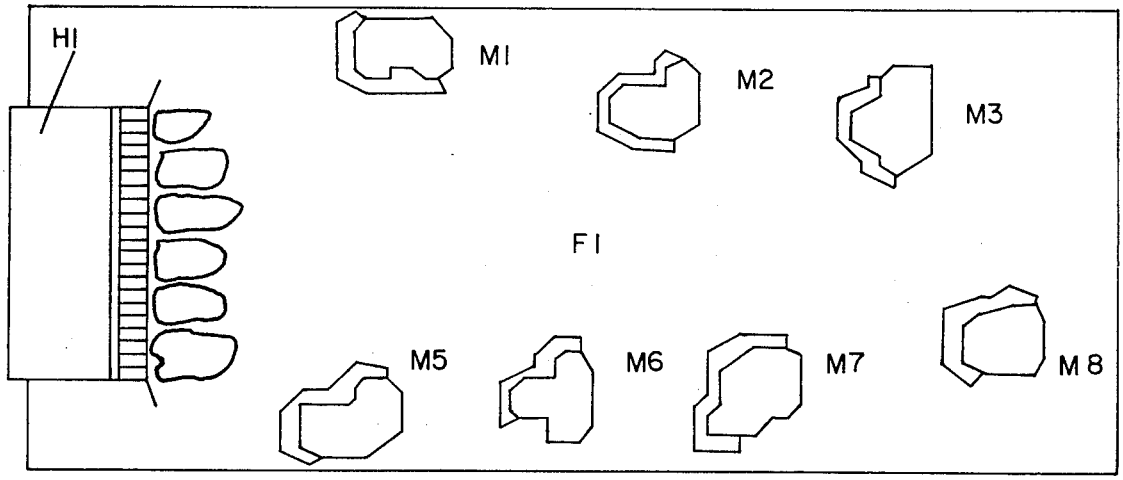

INDOOR/OUTDOOR RECREATIONAL GOLF FACILITY

BACKGROUND

The game of golf is understood to be a primary player participation game, i.e., more persons play the game of golf than any other game or sport. It is estimated that in order of fifteen million persons in the United States play the game of golf one or more times per year. The frequency of which each player plays the game of golf is dictated by many factors. Initially and the most significant is the weather; simply, golf is a seasonal game. Accordingly, especially in the northern climates, golf is played in the Spring, Summer, and Fall, with emphasis on play in the summer months.

It is appreciated that there presently exists sheltered driving ranges. However, it is equally appreciated that these driving range facilities are not adequate for providing the variety of play and the challenge associated with the game of golf.

From another standpoint, the public golf courses are crowded. The private golf courses are expensive and exclusive. Eighty six percent of the active number of golfers in the United States play on about fifty percent of the golf courses.

To compound the situation the rate of new golf course development has not kept pace with the increase of golfers. The cost of land and new golf course construction has prohibited the meeting of public demand for this type of outdoor recreation.

SUMMARY OF INVENTION

The present invention is for a golf facility that may be played the year around in the northern climates - and that uses approximately one tenth the area of that of a conventional 18 hole golf course. Principally the golf facility of the present invention is an indoor/outdoor facility. The golf facility in a preferred embodiment, in its broadest aspect, is a combination of a plurality of putting greens indoors, sheltered tees adjacent the indoor and exposed one side to the outdoor, a lesser number of mechanized range greens outdoors, and an outdoor pitching green, all arranged to simulate a conventional golf facility.

The most significant feature of the present invention is the outdoor mechanized range greens that are of a construction to receive and retrieve the ball through a position indicating mechanism. These greens are raised from the ground with an overall structure support. Each mechanized green consists of a netting material that is divided into individual segments. The sides of each segment slope downward to a ring in the center area. The ring in turn has a golf ball activated switch at its base.

A display board situated at each tee is manipulated to provide the game operations, instructions, and information, such as distance of hole. The board also directs the player as to where and how to proceed with the game, i.e., which green to hit to.

OBJECTS

It is accordingly a principal object of the present invention to provide a new and improved indoor/outdoor golf facility that utilizes only a small percentage of land space required by a conventional golf course.

A further object of the invention is for such a golf facility that may be played throughout the year in the northern climate, that does not require the walking, nor the time, to play the customary golf course.

Another object of the invention is to provide such a simulated green that automatically clears the green of any ball, retrieves the ball, and identifies the location of the ball relative to the flagstick.

Still a further object of the invention is to provide an indoor/outdoor golf facility that is a miniature in nature - but, yet, requires the skills to play a conventional golf course.

Other objects and features of the present invention will become apparent from the following detailed description when taken in conjunction with the drawings in which:

BRIEF DESCRIPTION OF DRAWINGS

FIG. 1 illustrates the mechanical range green in its preferred embodiment utilized in the indoor/outdoor golf facility.

FIG. 2 is a cross-sectional view of the mechanical range green of FIG. 1.

FIG. 3 is also a cross-section of the mechanical green of FIG. 1 with certain aspects illustrated in an exploded view.

FIG. 4 illustrates in elevation the display board typical of the plurality of display boards one for each tee.

FIG. 5 is a cross-sectional view of the display board of FIG. 4, and

FIG. 6 is a view of the yardage distance-direction drum, a component of the display board of FIGS. 4 and 5.

FIG. 7 is an overall view of the indoor/outdoor golf facility of the present invention.

DETAILED DESCRIPTION OF THE PRESENT INVENTION

Figure 8:
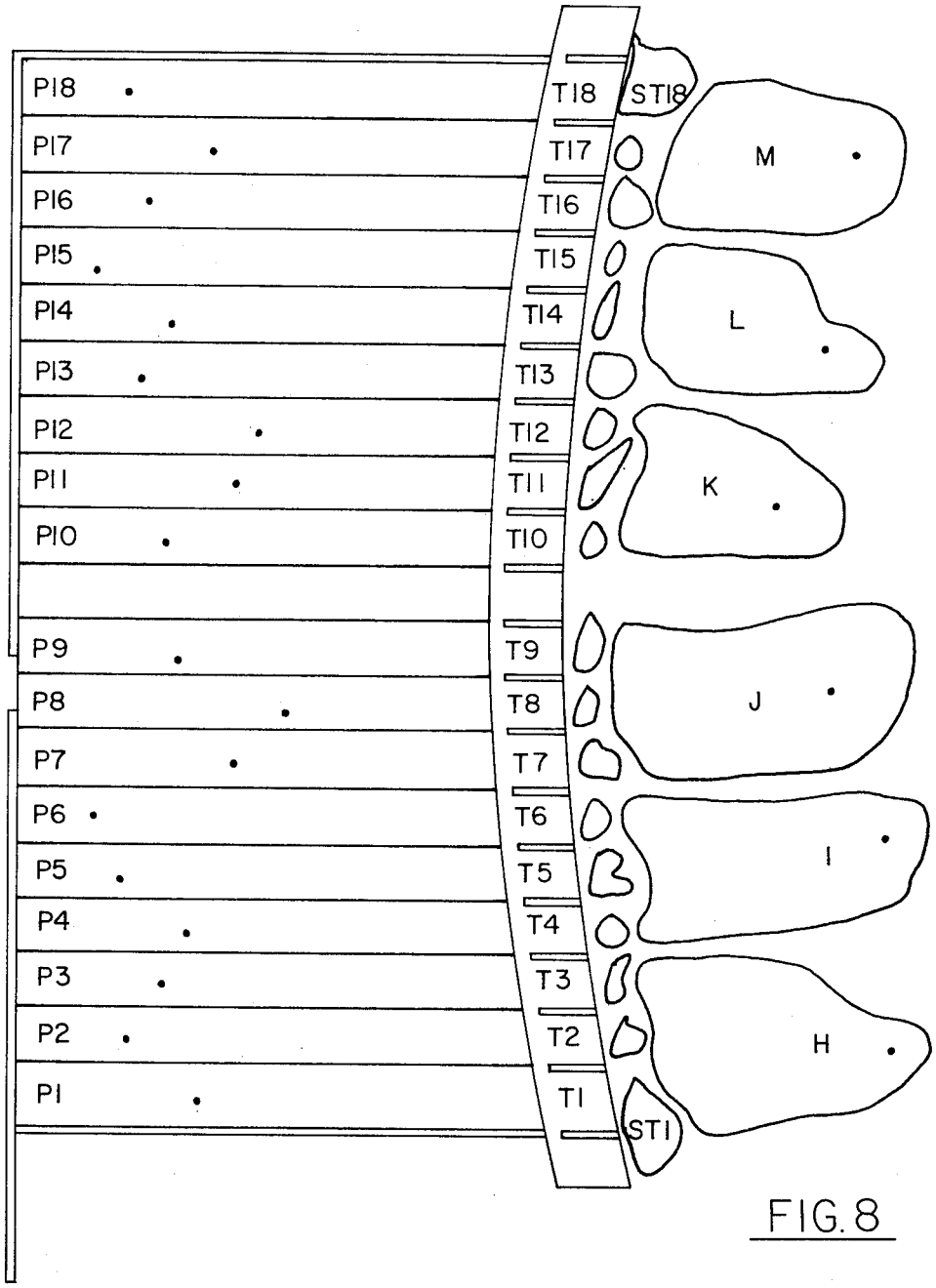
FIG. 8 illustrates the indoor area and the immediate outdoor area of the present invention.

With particular reference to FIG. 1 there is illustrated the mechanized range green that reduces the indoor/outdoor golf facility of the present invention to practicality. The green 10 is divided into segments or areas 10*a, xxx n*, each representative of a given distance from the flagstick 20. The green is supported by posts such as 22. A series of cross directional wire strands 12*a xxx n* and 13*a xxx n* support the mesh in a segmented configuration. The mesh 18 can be a netting material and preferably of a synthetic fiber such as nylon dyed green in the green area and white in the sand trap area. In the center of each segment there is a ringed "hole" 24 to receive the ball; and which ball, in turn, actuates a contact switch 25 to transmit which segment the ball hit onto. The flagstick 20, is more or less a center pole/flag denoting the conventional flagstick for the green. Surrounding most of the green 10 is the apron 16 extending from the edge of the green 10 to the ground. This apron is composed of a synthetic turf material to give the appearance of natural grass. Surrounding another portion of the green 10 is a simulated sand trap ST6 comprised of segments ST6 *axxn.*

Even though the mesh 18 is supported above ground, the apron 16 gives the appearance, from a distance, of that of a conventional golf green.

At the one end 14 of the green 10 there is a ball retrieval area. That is, every ball entering any one of the holes 24*a xxx n* in the segments 10*a xxx n* is directed to a central collection point 14.

Particular reference is made to FIG. 2, where there is illustrated the green 10 in cross-section and to FIG. 3 wherein certain portions of the cross-sectional view of FIG. 2 is exploded. A pair of posts 22 and 22a support the green 10 in a first direction and a pair of posts (not shown) support the green 10 in a second direction. The posts 22 as shown in FIG. 3 are sunk into the ground with a concrete base. An angle or knee brace also sunk into the concrete provides rigidity.

Suspended from the two-directional posts 22 is a network of supporting strands 12*a xxx n* the one direction and 13*a xxx n* in the other direction. The network of strands are such that in cross-section they divide the netting or mesh 18 into segments 10*a xxx n*.

In the center of each segment there is a ring structure with a hole 24. Initially the ring structure 24 provides the necessary weight for the mesh to slope from all directions to the center. The ring structure has a hole region 26 sloping to the bottom portion wherein a switch 25 is mounted. As the ball hits the mesh 18 it rolls toward the center, into the hole 24 and then drops further to actuate the electrical switch 25 as it passes through to the retrieval trough. As pointed out above each green has a ball retrieval area, accordingly each range green has a trough floor which slopes to a central reception area.

The apron 16 overhangs the uppermost part of the post 22 and is tautly supported at its outer perimiter with a below ground stake. The apron to provide a soft but rigid structure is supported on a plywood-type base 19 with an intermediate layer of foam rubber 17.

Referring again to FIG. 1 it is noted that the segments of the green 10 have a like-number notation thereon. In this embodiment the flagstick 20 is centrally located hence the segments that surround the flagstick are of equal distance, the next surrounding segments are of an additional equal distance and so on to the outer segments. In the configuration of FIG. 1, although 36 segments are shown, there are only six locations given. 1–5 distances from the center flagstick 20 and 6 sand trap. It can be appreciated then that a ball hitting in any segment having a location 1 through 6 will register in the display unit at the tee as a respective distance or trapped ball. This is simply accomplished by wiring together each switch 25 at the bottom of the hole 24 representing a segment having a like distance or location. The several fixed distances (in this instance 5) are selectively connected to the display device. Similarly the segments ST6 a xxx n represent given areas of a sand trap. A ball hitting one of these segments will register on the display device as sand trap.

The operation of the display or register device shown in FIGS. 4, 5 and 6 can best be understood with reference also to FIG. 7 illustrating schematically the indoor/outdoor golf facility of the present invention. Also to FIG. 8 which illustrates the indoor and sheltered play area. The facility as shown in FIG. 7 and particularly in FIG. 8 in a preferred embodiment comprises eighteen tees T1 through T18. These tees are outdoors but under weather cover on three sides. Accordingly, except in the most severe inclement weather, the player is not restricted by the weather in his play.

Dispersed in random positions in the general fairway F1 are seven mechanical range greens M1 through M7, as above described. Adjacent the tees T1-T18 is a pitching green divided into several greens as shown H, I, J, K, L, and M. Alternatively the pitching green may comprise several greens each having a hole positioned thereon. The pitching green is of the conventional golf type green except they may comprise synthetic turf in lieu of natural turf.

The pitching green is on the outside but the holes on the green are placed a distance sufficiently short for a "pitch shot". Distance markers for the distance to the respective holes are inlaid on the pitching green. Partially surrounding the pitching green are natural sand traps ST1 through ST18. The sand trap is positioned as a hazard between tees and/or adjacent to the pitching greens and are made up of real sand in much the same manner as a conventional sand trap.

In an inside area directly behind each tee is a putting green P1 through P18. These greens too are preferably artificial turf and of varying shapes and contours to simulate the conventional golf greens. Adjacent each tee is an electronic board 40 that displays, registers, and directs the course of play.

The operation of the indoor/outdoor golf facility of the preferred embodiment shown in FIGS. 7 and 8 is described relative to the display board of FIG. 4, and FIGS. 5 and 6. To initiate play, a player, upon receiving clearance, proceeds to the starting (first) tee. The display panel at 2 will indicate which of the seven mechanized range greens the player is to hit his first shot. The yardage of this green is given in the upper part.

If the hole is indicated as a par four or par five hole the player drives his first shot through the driving fairway F1 - the area intermediate along a direct center line between the mechanized range green.

The driving fairway has yardage distance markers. The player registers his estimated distance on the display board at 1 by rotating knob 36 which in turn indicates at display 2 "hit again", "register yardage", or "pitch to pitching green", or "hit to designated mechanized range green". As can be seen by reference to FIG. 6 the knob rotates cylinder 35 having pre-set thereon yardage distances with designated directions. The mechanized range green displayed at 2 will be any of M1 through M7, depending upon the difference of the yardage of the drive (or drives) and the yardage of the hole. The player continues to drive and record his yardage after each drive. The display board will continue to direct at 2 "hit to designated mechanized range green", or "pitch to pitching green".

With reference to FIG. 5 there is illustrated a side view of the display board of FIG. 4 to better illustrate its mechanical structure.

When the player's shot hits the indicated mechanized range green - such as a par 3 green on a first shot or on subsequent shots the distance from the flagstick will be electrically registered at 4 on the display board by the lighting of the appropriate distance indicator. The distance recorded on the display board is the player's "putting distance". A shot hit into a trap is registered on the board also at 4 by an indicator light as a trapped shot. Once on the proper green (and the shot has not been holed out) the player advances from the tee to the corresponding putting green and hand places his ball on a line on the putting green surface. The line selected will be a distance from the hole equal to the putting distance registered on the display board. The player proceeds in his turn to putt out until the ball is holed.

A shot hit to a directed mechanized range green which comes to rest in its sand trap is indicated on the display board. The player's next shot is played from the real sand trap to the nearest pitching green. In the event a shot is hit over the fence (out of bounds) into water or bunkers, an additional stroke must be counted and the shot played again.

Play on a hole when the player's first shot does not hit the designated mechanized green, or its sand trap will not be recorded on the display board. The player observes the yardage markers and records his estimated distance on the display board by rotating knob 36 or drum 35. When this is done the indicator at 2 will indicate which green the next shot is to be played. The player then hits his next shot to the mechanized range green as indicated. Upon hitting the green, the display board indicates the putting distance by the lighted displays at 4 and the player is ready to putt as previously directed. The procedure continues if the player fails to hit the designated letter green or its trap on any subsequent shot. He continues to record his estimated yardage on the display board. Directions will indicate hitting to another mechanized range green, a pitching green, or a blast from a sand trap.

If the player is directed to pitch to a pitching green, he selects that pitching green nearest his tee. If the shot comes to rest on the pitching green, the player observes the inlaid distance marks on the pitching green and estimates the putting distance. If the player is directed to pitch to the pitching green and the shot misses the pitching green, the player will play a chip shot at his next shot. The chip shot will be played from the chipping area inside on the putting green. If the player is directed to play from the sand trap and the trap shot misses the pitching green, the next shot will be played from the chipping area inside on the putting green.

Although certain and specific embodiments have been shown and described it is understood that modifications and departures may be had without departing from the spirit and scope of the invention.

What is claimed is:

1. An indoor/outdoor golf facility comprising a housing structure partially enclosed and an outdoor area, said outdoor area having randomly positioned thereon a plurality of open air range greens each range green comprising a plurality of continguous open segment areas, there lying below each open segment a tapering enclosure of netting tapering downwardly and terminating in a ring structure adapted to transfer a golf ball therethrough and to indicate the passage of said ball on a display board, each segmented area being indicative of a given distance or location from a flagstick positioned in said range green, a plurality of pitching greens positioned between said housing structure and said greens, a plurality of hitting tees in number corresponding to nine or multiples thereof, said tees positioned side-by-side in said partially enclosed area of said housing, a plurality of putting greens in number corresponding to said number of hitting tees; and a display board for each of said tees electrically connected to said range greens and adapted to showing thereon the hole being played, the yardage of the hole, and a direction to the player as to the green to be played.

2. The golf facility of claim 1 wherein said range greens each have a simulated sand trap positioned adjacent thereto.

3. The golf facility of claim 1 wherein each of said range greens includes a simulated apron.

4. The golf facility of claim 3 wherein each of said range green is supported above ground and said apron extends from said green to the ground.

5. The golf facility of claim 1 wherein said pitching greens have a sand trap positioned adjacent thereto.

6. The golf facility of claim 1 wherein said ring structure further comprises a ball activated switch electrically connected to said display board.

7. The golf facility of claim 1 wherein said range greens each include a ball retrieval area, and wherein said ring structure for each of said segments has means for delivering balls to said retrieval area.

8. The golf facility of claim 1 wherein said netting of each of said range greens is a netting of synthetic material.

* * * * *